US009979067B2

(12) United States Patent
Danderson

(10) Patent No.: US 9,979,067 B2
(45) Date of Patent: May 22, 2018

(54) N-WAY, RIDGED WAVEGUIDE, RADIAL POWER COMBINER/DIVIDER

(71) Applicant: Continental Microwave and Tool Co., Inc., Exeter, NH (US)

(72) Inventor: Brett Danderson, Lee, NH (US)

(73) Assignee: Continental Microwave and Tool Co., Inc., Exeter, NH (US)

( * ) Notice: Subject to any disclaimer, the term of this patent is extended or adjusted under 35 U.S.C. 154(b) by 41 days.

(21) Appl. No.: 15/158,241

(22) Filed: May 18, 2016

(65) Prior Publication Data

US 2017/0338539 A1 Nov. 23, 2017

(51) Int. Cl.
*H01P 5/12* (2006.01)
*H01P 5/16* (2006.01)

(52) U.S. Cl.
CPC ..... *H01P 5/16* (2013.01)

(58) Field of Classification Search
CPC ..... H01P 5/12; H01P 5/00; H01P 5/16; H01P 5/181
See application file for complete search history.

(56) References Cited

U.S. PATENT DOCUMENTS 4,641,107 A * 2/1987 Kalokitis ..... H03F 3/602 29/592.1
4,812,782 A * 3/1989 Ajioka ..... H01P 1/162 330/286
6,242,984 B1 * 6/2001 Stones ..... H01P 5/107 330/295
7,385,462 B1 * 6/2008 Epp ..... H01P 5/12 333/125
9,065,163 B1 * 6/2015 Wu ..... H01P 3/12

* cited by examiner

*Primary Examiner* — Robert J Pascal
*Assistant Examiner* — Kimberly Glenn
(74) *Attorney, Agent, or Firm* — Bond, Schoeneck & King, PLLC

(57) ABSTRACT

A microwave radial power divider/combiner device in which ridged waveguides structures are provided to provide adjacent-port isolation, large bandwidth, consistent cross-port phase matching, low insertion loss, and high peak and average power handling characteristics. The device includes a single rectangular input/output waveguide coupled to a bi-conical waveguide, which in turn is coupled to multiple ridged waveguides. These ridged radial waveguides are coupled to waveguide end-launches and impedance transformers located around the circumference of the device.

20 Claims, 4 Drawing Sheets

N-WAY, RIDGED WAVEGUIDE, RADIAL POWER COMBINER/DIVIDER

FIELD OF THE INVENTION

The present disclosure is directed generally to an N-way, ridged waveguide, radial power combiner/divider that minimizes loss while maintaining a matched condition on all ports.

BACKGROUND

A dual-purpose power combiner/divider is required for a solid state power amplifier design. Current technology for solid state combiner/divider designs uses microstrip, stripline, slabline, suspended substrate stripline, or waveguide designs. For example, Wilkinson power splitters, rat race, quadrature 90-degree hybrid, and reactive-tee are all types of splitters, combiners, and dividers that use microstrip, stripline, slabline, and suspended substrate stripline designs. Free-emitting conical radial power combiners and magic-tees use waveguide technology. Both the Wilkinson and wired radial power combiners/dividers are a form of a branching transmission line network, also called a corporate feed network.

The Wilkinson power combiner/divider is typically limited in how much power it can handle and dissipate. Its isolation resistors and the mode of propagation limit the power handling capability of the device versus waveguide architecture. For numerous power splits, a Wilkinson splitter has comparatively higher insertion loss than a ridged radial power combiner/divider device. Additionally, the Wilkinson power combiner/divider is highly frequency-dependent for isolation. As the frequency increases or decreases from the matched center frequency, the quarter-wave architecture limits the cancellation effects that are required for a Wilkinson device to maintain isolation. Because of this, additional quarter-wave sections and resistors may be added to increase the bandwidth, which may result in higher loss, increase in package size, and potentially lower power handling capabilities with added costs.

Existing radial power combiners use stripline, microstrip, slabline, and suspended substrate stripline designs. These technologies have comparatively higher insertion loss as compared to a ridged waveguide radial power combiner/divider. Furthermore, stripline, microstrip, slabline and suspended substrate stripline typically do not have the peak or average power handling characteristics of a ridged waveguide structure, thus significantly reducing the ability to produce high enough power to replace existing high power vacuum tube amplifiers.

The phase for both existing radial power combiners and Wilkinson combiner/dividers are highly dependent upon machining tolerances, or they will require additional RF+ tuning. This, in return, produces the potential for a considerable tolerance stack up that degrades the phase match across each port. The phase match of the network becomes more complicated as the number of ports increase; in other words, as the number of ports increase in a branching transmission line, the branching network gets larger, which increases how much the phasing will deviate between ports due to slight geometric changes in the branching structure and quarter wave transforms. Phase matching is critical for combining and dividing structures. Signals that are out of phase are prone to cancel each other out, multiply the signal, or decrease the signal strength. Depending on how broadband the combiner/divider is, a change in frequency could create inconsistent energy transfer. The decrease in signal strength reduces the efficiency of the amplifying network. A free-emitting conical radial power combiner shares many of the same disadvantages as the branching transmission line networks described above. However, where a free-emitting radial power combiner lacks in cross-port isolation, it has a significant improvement in cross port phase matching and insertion loss performance, which is also not limited by the quantity of ports.

Accordingly, there is a continued need in the art for an n-way power combiner/divider that minimizes loss while maintaining a matched condition on all ports. An N-way radial power combiner/divider that has low insertion loss, high power handling, good isolation, and phase matching may allow for the design of efficient High-Power Solid State Amplifiers that are fault-tolerant. The efficiency of an N-way, Ridged Waveguide, Radial Power Combiner/Divider does not degrade substantially if one or more modules fail, allowing continued operation, often referred to as graceful degradation.

SUMMARY OF THE INVENTION

The present disclosure is directed to an N-way, ridged waveguide, radial power combiner/divider (NRRPCD) offering performance characteristics that are desirable for many applications. The NRRPCD has very low insertion loss due to the inherently low loss of waveguide when compared to other transmission structures. The waveguide ridges provide spatial separation that result in adjacent-port isolation that minimizes the effect that a failed module would have on the output of a transmitter. The symmetric geometry of the NRRPCD allows good port-to-port amplitude balance of and phase matching. The phase match tolerance between radial ports is not directly dependent on the quantity of ports on the NRRPCD. As the number of ports increases on an NRRPCD the maximum phase differential remains constant.

One embodiment of the NRRPCD is a radial power combiner/divider that includes a coaxial bi-conical center port, multiple end-launch waveguide launches coupled to the bi-conical center port, and multiple impedance transformers coupled to the multiple end-launch waveguide launches. The bi-conical center port may include an impedance transformer to transition to a coaxial or waveguide output, and may be completely or partially encased in and/or surrounded by a dielectric. One possible example of a dielectric, for example, includes a fluorocarbon dielectric such as Teflon®, Rulon®, or Fluoroloy®, or a ceramic dielectric such as boron nitride. An air dielectric may also be used, along with any other suitable dielectric. The multiple end-launch ridged waveguides may be stepped waveguides or tapered waveguides, and the multiple end-launch ridged waveguides can include air dielectrics and metallic outer conductors. In the case of stepped waveguides, the waveguides may be Chebyshev transformers. The multiple impedance transformers can include single-step cylinders, multiple-step cylinders, or conical frustums, and can be coupled to corresponding coaxial ports.

Generally, in one aspect, a radial power combiner/divider is provided. The radial power combiner/divider includes a bi-conical center port; a plurality of waveguide end launches, each waveguide end launch coupled to the bi-conical center port; and a plurality of impedance transformers, each of the plurality of impedance transformers coupled to a respective one of the plurality of waveguide end launches.

According to an embodiment, the bi-conical center port comprises an impedance transformer.

According to an embodiment, the bi-conical center port comprises a dielectric material. According to an embodiment, the bi-conical center port is at least partially encased in the dielectric material.

According to an embodiment, the waveguide end launches are stepped waveguides. According to an embodiment, the stepped waveguides are Chebyshev transformers.

According to an embodiment, the waveguide end launches are tapered waveguides.

According to an embodiment, the waveguide end launches comprise an air dielectric and a metallic outer conductor.

According to an embodiment, the impedance transformers comprise single-step cylinders, multiple-step cylinders, and/or conical frustums.

According to an embodiment, the impedance transformers are coupled to corresponding coaxial ports.

According to an embodiment, the impedance and/or capacitance septums are placed at least partially between neighboring impedance transformers and/or neighboring waveguides.

According to an aspect is a radial power combiner/divider including a bi-conical center port comprising a dielectric material; a plurality of stepped waveguide end launches, each waveguide end launch coupled to the bi-conical center port; and a plurality of impedance transformers, each of the plurality of impedance transformers coupled to a respective one of the plurality of waveguide end launches.

According to an aspect is a radial power combiner/divider, including a bi-conical center port comprising a dielectric material; a plurality of waveguide end launches having a first end and a second end, each waveguide end launch coupled at its first end to the bi-conical center port; a plurality of impedance transformers, each of the plurality of impedance transformers coupled to the second end of a respective one of the plurality of waveguide end launches; and a plurality of coaxial ports, each of the plurality of coaxial ports coupled to a respective one of the plurality of impedance transformers.

These and other aspects of the invention will be apparent from the embodiments described herein.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF EMBODIMENTS

The present disclosure describes various embodiments of an N-way, ridged waveguide, radial power combiner/divider. The NRRPCD comprises a coaxial bi-conical center port, multiple end-launch waveguide launches coupled to the bi-conical center port, and multiple impedance transformers correspondingly coupled to the multiple end-launch waveguide launches. According to an embodiment, the NRRPCD utilizes an impedance transformer to step down the impedance to a desired value, a waveguide ridged end-launch, and a bi-conical center port that re-matches the impedance as the signal is either combined or divided. The geometry of these structures can vary depending on the frequency band of interest, the performance requirements (power handling, insertion loss, return loss, phase match, isolation, etc.), the geometric limitations, and the number of ports the combiner/divider has. The impedance transformer can include a single step cylinder, multiple step cylinders, or a conical frustum; the impedance transform shifts the impedance at the radial ports to the corresponding internal NRRPCD impedance.

According to an embodiment the ridged waveguide is a single-ridge structure that can be either tapered or stepped. In the case of stepped waveguides, for example, the waveguides may be Chebyshev transformers. Chebyshev transformers are quarter-wave transformers that utilize steps to make a match and have a more abrupt transformation section, allowing for a shorter launch to maintain the required mechanical package.

The ridge launches the waveform from a TEM mode in the coaxial ports into a primary TE01 mode and back to a TEM mode to exit the coaxial ports. The mode of propagation can go in either direction, originating in the radial ports and combined to exit the center port, or in through the center port and divided to leave by way of the radial ports. The bi-conical portion of NRRPCD shifts the mode of propagation from TE01 to TEM and transforms the impedance at the center port. Dielectric loading can be used to fill the impedance transformer, waveguide ridge, and the bi-conical structure for tuning purposes or power handling capability enhancements. The waveguide cavity where the TE01 mode is most prevalent is primarily an air dielectric with a metallic outer conductor.

Example 1—12-Way, S-Band, NRRPCD

Figure 1:
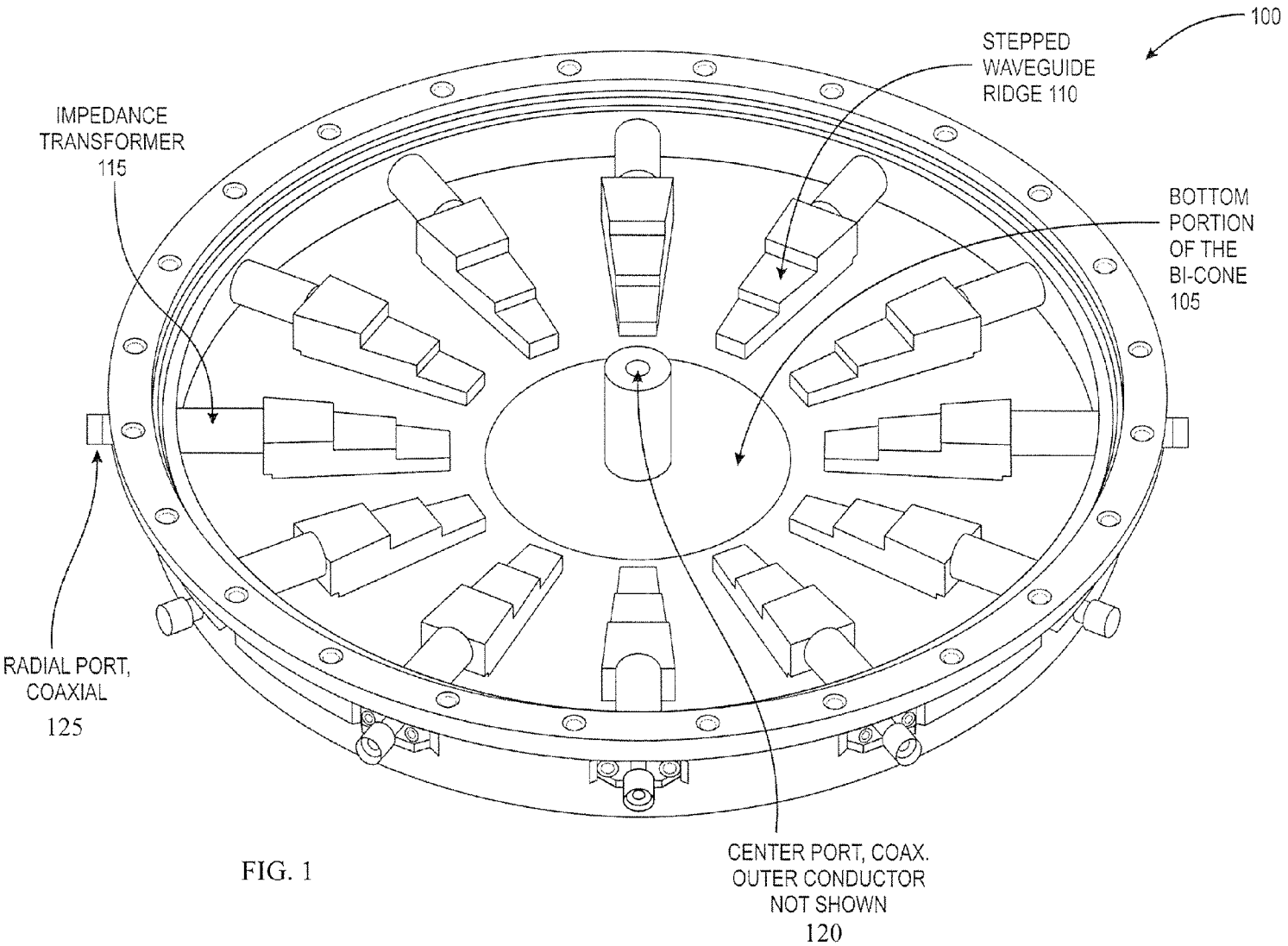
FIG. 1 is a schematic representation of an internal view of a 12-Way NRRPCD exposing the symmetrically-patterned radial combining/dividing structures and the bi-conical center port, in accordance with an embodiment.

Referring to FIG. 1 is an example of an internal view of a solid model for a 12-Way NRRPCD 100, according to an embodiment. The figure shows the 12-Way design 100 without the cover, exposing the symmetrically-patterned radial combining/dividing structures and the bi-conical center port 105. The cross section in FIG. 1 shows a bi-conical center port 105, multiple end-launch waveguide launches 110 coupled to the bi-conical center port 105, and multiple impedance transformers 115 correspondingly coupled to the multiple end-launch waveguide launches 110. Coupled to the impedance transformers 115 are corresponding radial ports 125.

The 12-Way design 100 has a single step cylinder impedance transform and a stepped waveguide end-launch ridge. The bi-conical center port 105 may include an impedance transformer, and may be encased in a dielectric 120. The dielectric can also be used to electrically tune the structure's resonant cavity.

According to an embodiment of the 12-Way, S-Band, NRRPCD 100, the electrical performance can be centered between 2.7 GHz and 3.1 GHz. The return loss has a worst case match of ≈14 dB at the center port. The center port's 105 resonant frequency can be tuned in the S-band, with a center frequency of 2.9 GHz and a bandwidth of 2.7 to 3.1

GHz. The radial ports 130 have a flatter frequency response that is broader in bandwidth as compared to the center port 105; this is a typical response of an NRRPCD operating in the S-band.

The isolation can also be increased between adjacent ports by a minimum of 5 dB by the use of centered and parallel placed resistive sheets. RC (resistive and capacitive) tuning structures can also be placed between the radial impedance transforms or waveguide ridges to also increase isolation and decrease the radial ports' return loss. The increase in isolation for either of these features comes at a cost of insertion loss; a trade-off off isolation/return loss vs. insertion loss. These features are called "septums." The septums may be impedance septums and/or capacitance septums.

According to an embodiment, the ports that have the best isolation in the 12-Way NRRPCD network are the ports that are directly across (180 degrees) from each other. One of the best isolations in this embodiment is approximately 18.75 dB. One of the worst case port-to-port isolation in this embodiment is approximately −6.6 dB. The average port-to-port isolation for the 12-Way NRRPCD is −13.7 dB. The overall loss at each port with the coupling is 11 dB, the coupling accounts for 10 Log(12)=10.79 dB of loss, the difference between the overall loss and the coupling loss gives an insertion loss of 0.21 dB. The phase stability of a NRRPCD is closely matched without the need for secondary tuning due to the symmetric geometry and often one-piece machining of the ridges. The 12-Way shows a phase tolerance of ±2.25 degrees across the band width of 2.7 GHz to 3.1 GHz. The disclosed design was tested with phase matched adapters so the actual phase tolerance is closer to ±1 degree from 2.7 GHz to 3.1 GHz. The 12-Way NRRPCD is designed to handle >36 kW peak power with a duty cycle: 10%, Pulse width: <100 μS.

Example 2—68-Way, X-Band, NRRPCD

Figure 2:
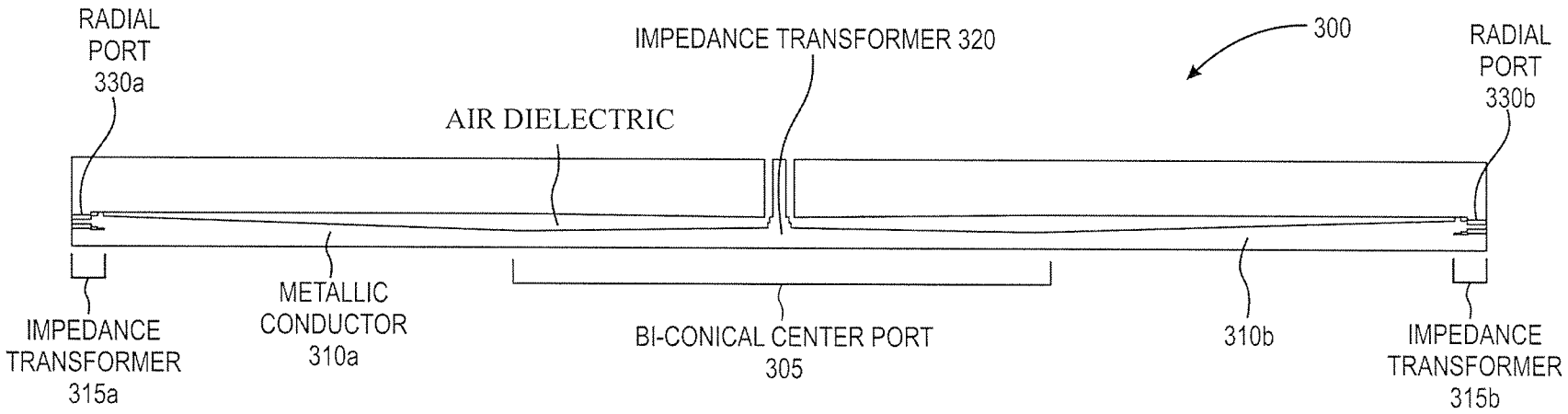
FIG. 2 is schematic representation of a cross-sectional view of a 68-Way NRRPCD, in accordance with an embodiment.

Referring to FIG. 2 is a cross-sectional view of a 68-Way, X-Band, NRRPCD 300, according to an embodiment. The cross-section shows a bi-conical center port 305, left and right end-launch waveguide launches 310*a,b* coupled to the bi-conical center port 305, and left and right impedance transformers 315*a,b* correspondingly coupled to the multiple end-launch waveguide launches 310*a,b*. The bi-conical center port 305 may include an impedance transformer 320, and may be encased in a fluorocarbon dielectric. Coupled to the impedance transformers 315*a,b* are corresponding radial ports 330*a,b*. While the cross section of FIG. 2 shows only two waveguide end-launches 310*a,b*, two impedance transformers 315*a,b*, and two radial ports 330*a,b*, it should be understood that the particular 68-Way design 300 has 68 such waveguide end-launches, impedance transformers, and radial ports.

Figure 3:
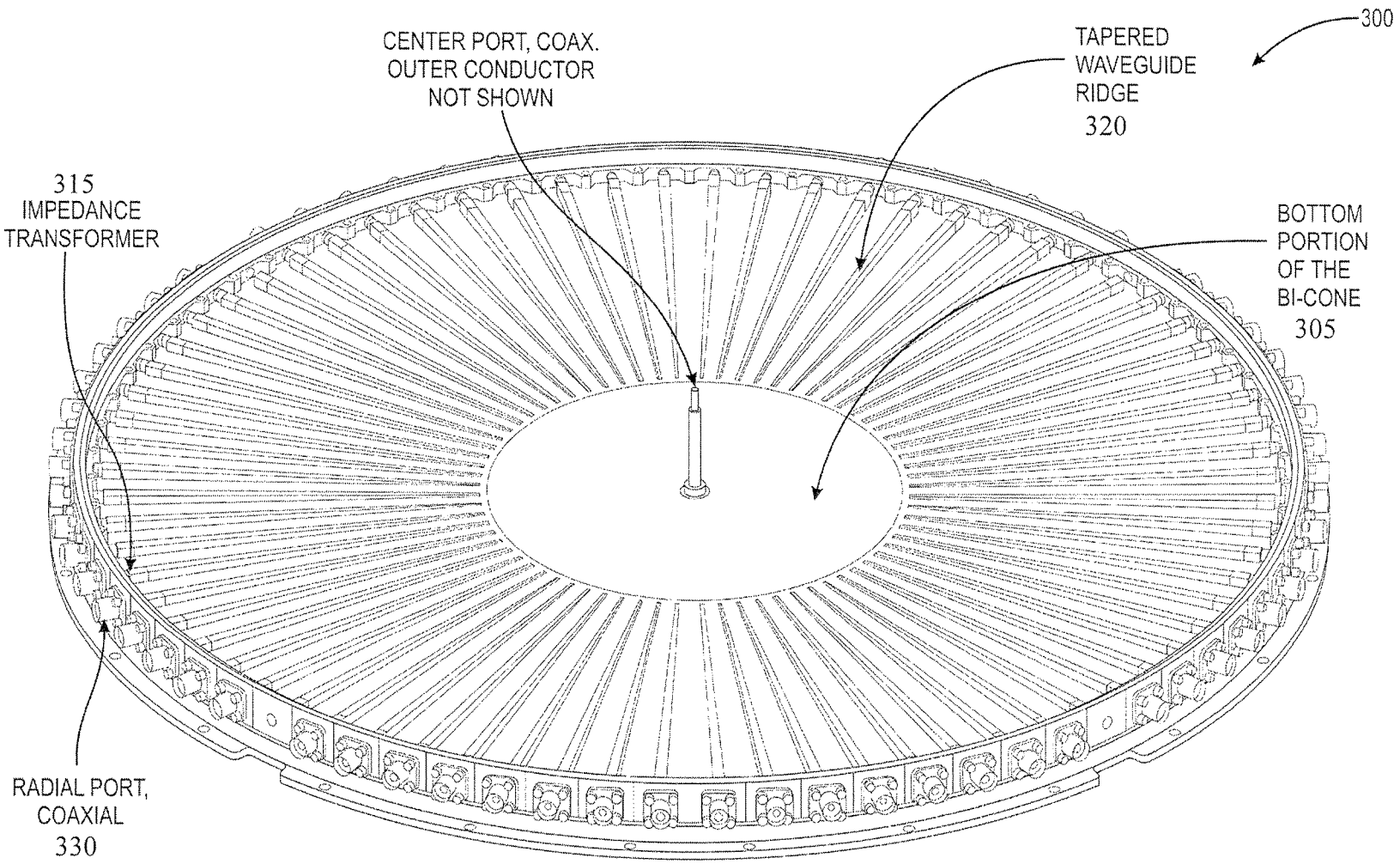
FIG. 3 is a schematic representation of an internal view of the 68-Way NRRPCD of FIG. 2, in accordance with an embodiment.

Referring to FIG. 3 is an internal view of the 68-Way NRRPCD 300 of FIG. 2, according to an embodiment. The cover of the NRRPCD is removed to show the ridge structure. In this embodiment, the frequency range of operation is centered in the X-band. For example, the frequency range of operation can be from 9.9 Ghz to 10.9 Ghz. According to an embodiment, the 68-Way design shown has four ports removed from a similar 72-Way design; this particular 68-Way Combiner/Divider model can operate as either a 72-Way NRRPCD or a 68-Way NRRPCD. Due to the geometric symmetry of NRRPCDs, a reduction in ports (however size and frequency dependent) can be configured by removing symmetrically paired ports with minimal degradation to signal propagation, frequency response, and resonant cavity. According to an embodiment, the 68-Way design 300 utilizes a tapered ridge waveguide as opposed to the 12-Way design's 100 (FIG. 1) stepped ridge waveguides.

Tests have shown that the port-to-port isolation of the 72-Way NRRPCD network design is approximately 16 dB, but with an average of 19 dB and going as low as 24 dB. The overall loss at each port including the coupling is 18.65 dB, the coupling accounts for 10 Log(72)=18.57 of loss, the difference between the overall loss and the coupling loss equates to an insertion loss of 0.08 dB. The return loss of the 72-Way NRRPCD is approximately 20 dB. The phase variance is ±1.75°@10.4 GHz. The 68-Way NRRPCD is designed to withstand 100 watts CW per channel in the X-Band, for a total of 6,800 watts CW.

Example 3—75-Way, S-Band, NRRPCD

Figure 4:
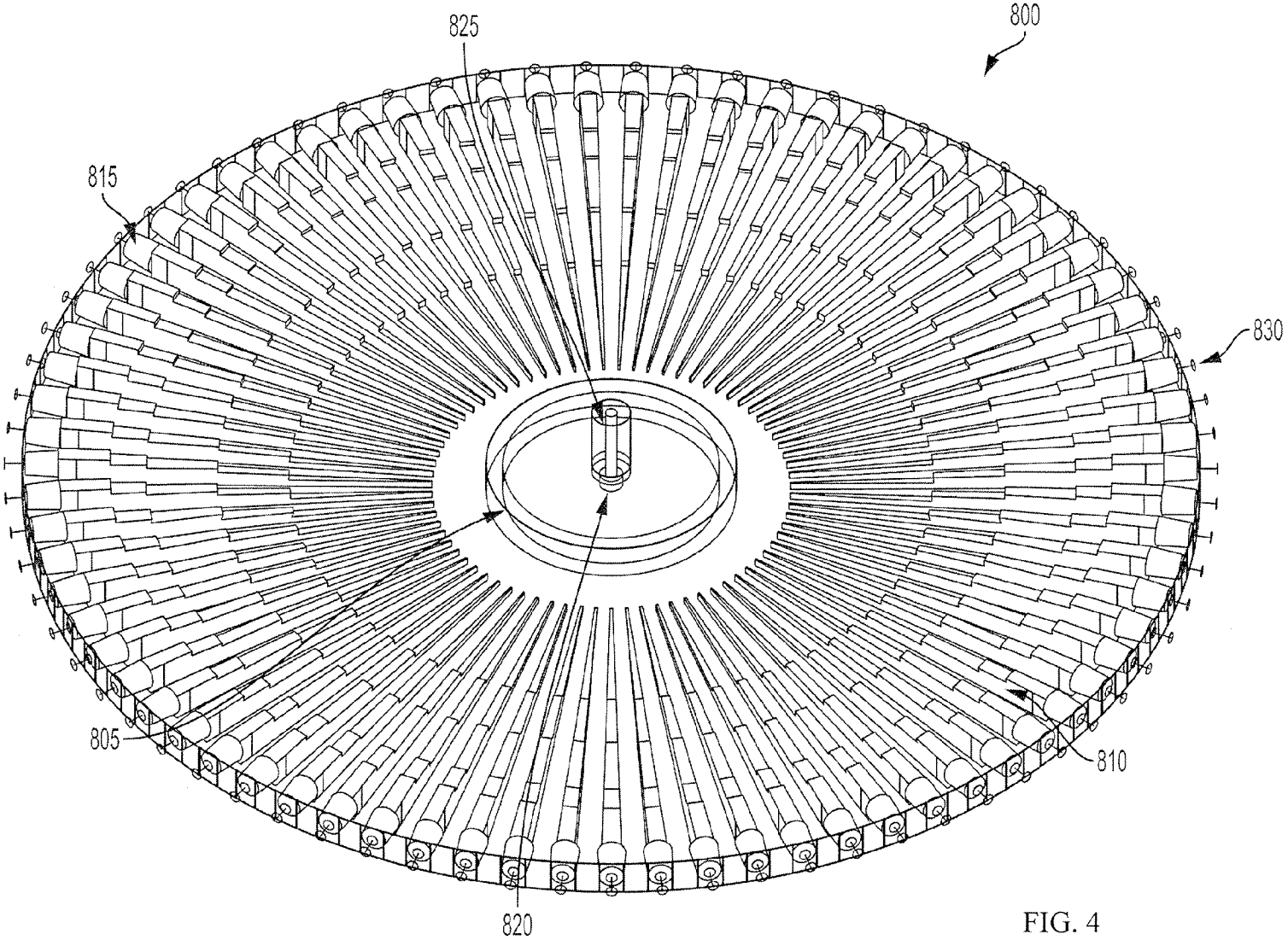
FIG. 4 is schematic representation of the internal view of a 75-Way NRRPCD, in accordance with an embodiment.

Referring to FIG. 4 is an internal view of a RF simulation model of an example of a 75-Way, S-Band, NRRPCD 800, according to an embodiment. A single stepped ridge and half of the bi-conical center port are shown. FIG. 4 shows a bi-conical center port 805, an end-launch waveguide 810 coupled to the bi-conical center port 805, and an impedance transformer 815 coupled to the end-launch waveguide 810. The bi-conical center port 805 may include an impedance transformer 820, and may be encased in a dielectric 825. Coupled to the impedance transformer 815 is a radial port 830.

The example 75-Way design 800 uses a stepped ridge structure that resembles the 12-Way design 100. The impedance transform 815 on the radial port 830 uses a conical frustum that launches into the tapered stepped ridge 810. The bi-conical center port 805 is encased in a fluorocarbon dielectric 825 to increase the peak and average handling power. The fluorocarbon 825 can be used as a heat transfer medium and a matching dielectric. According to an embodiment, the 75-Way NRRPCD 800 is designed to operate in the S-band with the center frequency set at 3.3 GHz, and the frequency response designed to be between 3.1 GHz and 3.5 GHz.

Test have shown that the port-to-port isolation of the 75-Way NRRPCD design 800 has a worst case isolation of 10 dB for adjacent ports, with an average of 23 dB and exceeding 40 dB with select ports and frequencies. The average port-to-port isolation for the 75-Way NRRPCD is −13.7 dB. The overall loss at each port with coupling in mind is 11 dB; the coupling accounts for 10 Log(12)=10.79 dB of loss; the difference between the overall loss and the coupling loss gives the insertion loss of 0.21 dB. The 75-Way NRRPCD is designed to handle >175 kW peak power, and 5.6 kW average power in the S-band.

While this invention has been particularly shown and described with references to example embodiments thereof, it will be understood by those skilled in the art that various changes in form and details may be made therein without departing from the scope of the invention encompassed by the appended claims.

What is claimed is:

1. A radial power combiner/divider comprising:

a bi-conical center port;

a plurality of waveguide end launches, each waveguide end launch coupled to the bi-conical center port; and a plurality of impedance transformers, wherein each of the plurality of impedance transformers is coupled to a respective one of the plurality of waveguide end launches.

2. The radial power combiner/divider of claim 1, wherein the bi-conical center port comprises an impedance transformer.

3. The radial power combiner/divider of claim 1, wherein the bi-conical center port comprises a dielectric material.

4. The radial power combiner/divider of claim 3, wherein the bi-conical center port is at least partially encased in the dielectric material.

5. The radial power combiner/divider of claim 1, wherein the plurality of waveguide end launches are stepped waveguides.

6. The radial power combiner/divider of claim 5, wherein the stepped waveguides are Chebyshev transformers.

7. The radial power combiner/divider of claim 1, wherein the plurality of waveguide end launches are tapered waveguides.

8. The radial power combiner/divider of claim 1, wherein the plurality of waveguide end launches comprises an air dielectric and a metallic outer conductor.

9. The radial power combiner/divider of claim 1, wherein the plurality of impedance transformers comprise single-step cylinders.

10. The radial power combiner/divider of claim 1, wherein the plurality of impedance transformers comprise multiple-step cylinders.

11. The radial power combiner/divider of claim 1, wherein the plurality of impedance transformers comprise conical frustums.

12. The radial power combiner/divider of claim 1, wherein the plurality of impedance transformers are coupled to corresponding coaxial ports.

13. The radial power combiner/divider of claim 1, wherein impedance and capacitance septums are placed between the plurality of impedance transformers or the plurality of waveguides.

14. A radial power combiner/divider, comprising:

a bi-conical center port wherein the bi-conical center port comprises a dielectric material;

a plurality of stepped waveguide end launches, each waveguide end launch coupled to the bi-conical center port; and a plurality of impedance transformers, wherein each of the plurality of impedance transformers is coupled to a respective one of the plurality of waveguide end launches.

15. The radial power combiner/divider of claim 14, wherein the bi-conical center port comprises an impedance transformer.

16. The radial power combiner/divider of claim 14, wherein the stepped waveguides are Chebyshev transformers.

17. A radial power combiner/divider, comprising:

a bi-conical center port, wherein the bi-conical center port comprises a dielectric material;

a plurality of waveguide end launches having a first end and a second end, each waveguide end launch coupled at its first end to the bi-conical center port;

a plurality of impedance transformers, wherein each of the plurality of impedance transformers is coupled to the second end of a respective one of the plurality of waveguide end launches; and a plurality of coaxial ports, wherein each of the plurality of coaxial ports is coupled to a respective one of the plurality of impedance transformers.

18. The radial power combiner/divider of claim 17, wherein the bi-conical center port is at least partially encased in the dielectric material.

19. The radial power combiner/divider of claim 17, wherein the plurality of waveguide end launches are stepped or tapered waveguide end launches.

20. The radial power combiner/divider of claim 17, further comprising an impedance septum and/or a capacitance septum placed between neighboring impedance transformers and/or neighboring waveguides.

* * * * *